United States Patent [19]

Bader, Jr. et al.

[11] 4,129,254

[45] Dec. 12, 1978

[54] ELECTROMAGNETIC UNIT FUEL INJECTOR

[75] Inventors: Ernest Bader, Jr.; John I. Deckard; Dan B. Kuiper, all of Grand Rapids, Mich.

[73] Assignee: General Motors Corporation, Detroit, Mich.

[21] Appl. No.: 832,073

[22] Filed: Sep. 12, 1977

[51] Int. Cl.[2] ..... F02M 47/02; F02M 55/00

[52] U.S. Cl. ..... 239/96; 123/139 AK; 123/139 E; 239/585

[58] Field of Search ..... 239/88–91, 239/93–96, 124, 533.5, 533.9, 585; 123/32 AE, 139 AE, 139 AK, 139 E

[56] References Cited

U.S. PATENT DOCUMENTS

| | | | |
|---|---|---|---|
| 3,006,556 | 10/1961 | Shade et al. | 239/90 X |
| 3,680,782 | 8/1972 | Monpetit et al. | 239/96 |
| 3,777,977 | 12/1973 | Regneault et al. | 239/585 X |

*Primary Examiner*—Evon C. Blunk
*Assistant Examiner*—Andres Kashnikow
*Attorney, Agent, or Firm*—Arthur N. Krein

[57] ABSTRACT

An electromagnetic unit fuel injector for use in a diesel engine includes a pump, in the form of a cam actuated plunger reciprocable in a bushing, to supply fuel at high pressure to a variable volume pressure accumulator chamber and through a flow control orifice to a control chamber in supply flow communication with a fuel injection nozzle assembly having a pressure actuated injection valve controlling the injected charge of fuel from the unit. Flow through the control orifice into the control chamber is selectively controlled by an electromagnetic valve assembly which also selectively controls flow from the control chamber through a drain orifice to a low pressure fuel return or drain line.

5 Claims, 8 Drawing Figures

ELECTROMAGNETIC UNIT FUEL INJECTOR

FIELD OF THE INVENTION

This invention relates to unit fuel injectors of the type used for injecting fuel into the cylinder of a diesel engine and, in particular, to an electromagnetic unit fuel injector.

DESCRIPTION OF THE PRIOR ART

Unit fuel injectors of the so-called jerk-type used for the pressure injection of liquid fuel into the cylinder of a diesel engine are well known and include in one unit a cam actuated pump in the form of a plunger and bushing for pressurizing fuel to a relatively high pressure to effect unseating of a pressure actuated injection valve in the fuel delivery injection valve or nozzle assembly of such a unit injector. In the unit fuel injectors now commonly in use, the plunger of the pump is not only reciprocated, but it can also be rotated about its axis by means of a rack in mesh with a gear through which the plunger reciprocates whereby to control the fuel output of the injector by changing the relation of the usual helices provided on the plunger of such a unit relative to the fuel passage ports in the bushing. The plunger helices of such units have an injection timing function in addition to their metering function. As is well known, the helices of the plunger may be machined, as desired, so as to vary the time of injection at various loads with respect to the engine piston position. With such an arrangement, either or both beginning and ending of injection may be retarded, advanced, or maintained constant with an increase in injector output, depending upon engine requirements. This feature of such injectors limits a particular injector to one engine family class for which the injector has been designed and, of course, the particular shape of the helices on its plunger controls the operation of that injector in a fixed predetermined manner.

SUMMARY OF THE INVENTION

The present invention provides an electromagnetic unit fuel injector, as for a diesel engine, which includes an injector housing enclosing at one end thereof an electromagnetic means having a movable armature carrying a control valve and an opposed retractor valve, both movable as a unit with the armature of the electromagnetic means to control the ingress and egress of fluid to and from a control chamber within the injector housing, the injector housing at its opposite end providing a spray tip with spray orifice passages therethrough with flow therefrom controlled by a pressure actuated injector valve slidably mounted within the injector housing. An engine cam actuated plunger and cylinder arrangement is also enclosed within the injector housing for supplying high pressure fuel to a variable volume accumulator chamber provided with the injector housing and, through a control orifice to the control chamber with flow through the control orifice being controlled by the control valve. The control chamber is in direct open communication with discharge passage means for supplying fuel to the spray tip for discharge out through the spray orifice passages as controlled by the injector valve, the control chamber also being in communication via a fuel return bleed orifice, flow through which is controlled by the retractor valve, to a low pressure drain line. Fuel at an intensified high pressure, as supplied by the pump assembly of this unit, is stored in the accumulator chamber so that injection of fuel is controlled by operation of the electromagnetic means whereby to provide quality, pressure-rate control characteristics and pilot injection, as desired.

It is therefore a primary object of this invention to improve a unit injector by the incorporation therein of electromagnetic valve control of injection to provide quantity, pressure-rate control injection characteristics and pilot injection, if desired.

Another object of this invention is to improve a unit fuel injector which is operative to reduce undesirable engine emissions, specifically unburned hydrocarbons, by permitting the electronic advancing, by actuation of an electromagnet valve, to effect the beginning of injection of the pilot and main charges independently with respect to engine revolutions per minute and load, and the nitrogen oxides by controlling the initial heat release by reducing fuel injected in the ignition delay period.

It is a further object of the invention to improve a unit fuel injector for use in a diesel engine which is operative so as to effect a reduction of engine noise and mechanical stresses by the control of the injection rate profile of the main charge, with the flexible characteristics of pilot injection, if desired.

For a better understanding of the invention, as well as other objects and further features, reference is had to the following detailed description of the invention to be read in connection with the accompanying drawings.

DESCRIPTION OF THE PREFERRED EMBODIMENT

Figure 1:
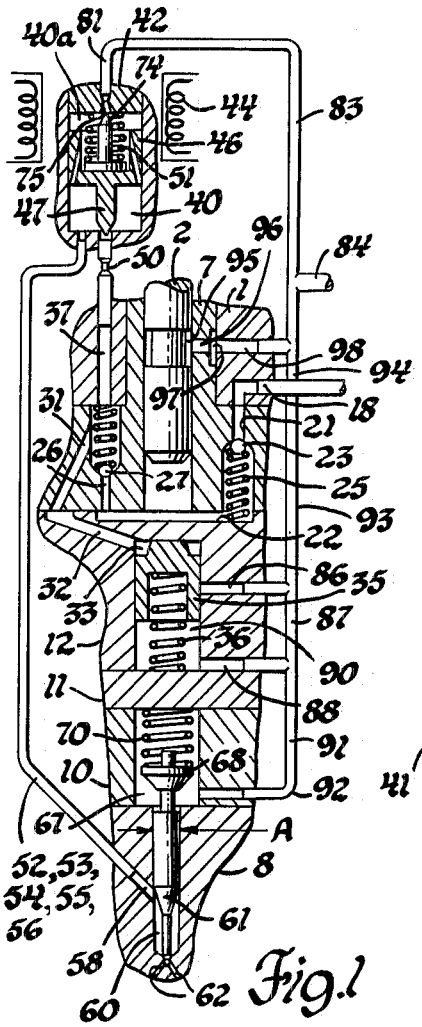
FIG. 1 is a schematic illustration of the primary operating elements of an electromagnetic unit fuel injector in accordance with the invention.

Referring now to the drawings and, in particular, to FIGS. 2 through 8, inclusive, there is shown an electromagnetic unit fuel injector in accordance with the invention, that is, in effect, a unit fuel injector — pump assembly with a solenoid valve incorporated therein to control fuel discharged from the injector nozzle portion of this assembly. As shown, the electromagnetic unit fuel injector includes a hollow body or housing 1 having a pump plunger 2 and a plunger actuated follower 3 reciprocally mounted therein. The follower 3 extends out one end of the housing 1 whereby it and the plunger connected thereto are adapted to be reciprocated by an engine driven cam or rocker, not shown, and by a plunger return spring 4 in a conventional manner, a stop pin 5 extending through the housing to limit upward travel of the follower 3.

Forming an extension of and threaded to the lower end of the housing 1 is a nut 6 within which is supported a bushing-cage 7 with a through bore **7*a* therethrough to provide the pump cylinder for the plunger 2, this bushing-cage hereinafter being referred to as the bushing 7. As shown, the bushing 7 is of external stepped configuration whereby its upper end is supported within the housing 1**.

Nut 6 has an opening **6*a* at its lower end through which extends the lower end of the combined injection spray tip and valve body 8, hereinafter referred to as the valve body, of a fuel injector nozzle assembly which may be of any suitable type known in the art. As shown, the valve body 8 is enlarged at its upper end to provide a shoulder 8*a* which seats on an internal shoulder 6*b* provided by the through counterbore in nut 6. Between the valve body 8 and the bushing 7 there is positioned, in sequence starting from the valve body, a rate spring cage 10, a cross-over cage 11 and an accumulator cage 12, these elements being formed, in the construction illustrated, as separate elements for ease of manufacturing and assembly. The threaded connection 14 of the nut 6 to housing 1 holds the valve body 8, rate spring cage 10, cross-over cage 11 and accumulator cage 12 clamped and stacked end-to-end between the upper face 8*b* of valve body 8 and the bottom face 7*b* of bushing 7**. All of these above described elements have lapped mating surfaces whereby they are held in pressure sealed relation to each other and, in addition, dowels, not shown, are used to maintain the desired, aligned, position of these elements relative to each other in a manner well known in the art.

Figure 4:
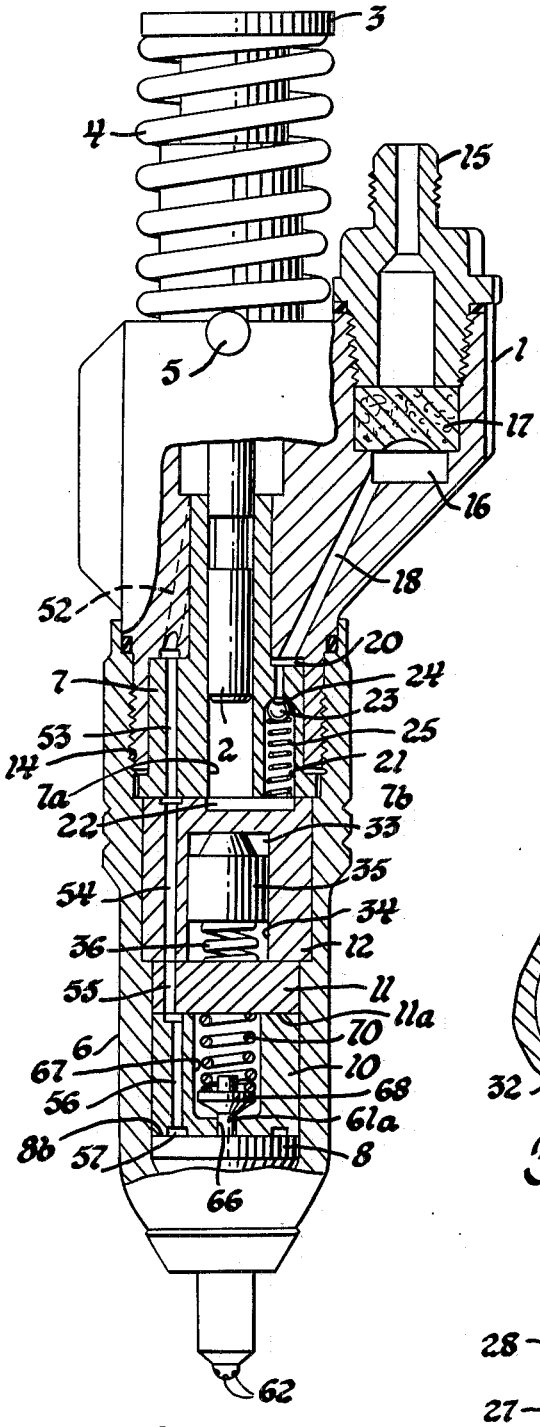
FIG. 4 is a sectional view taken along line 4—4 of FIG. 3.

Fuel as from a fuel tank via a supply pump and conduit, not shown, is supplied to the lower open end of the bushing 7 by a fuel supply passage means which includes an apertured inlet or supply fitting 15, as shown in FIG. 4, fixed to the housing 1 that leads to a filter chamber 16, provided within the housing, containing a filter 17. The outlet from the filter chamber 16 communicates via a passage 18 in housing 1 with a recessed channel 20 in the upper end of bushing 7 and then via a stepped passage 21 through the bushing to a recessed cavity 22 provided in the upper end of the accumulator cage 12, this cavity 22 being in flow communication with the lower open end of the bushing 7. Flow through the inlet passage means is controlled by a one-way check valve shown in the form of a ball 23 positioned in the enlarged portion of the passage 21 and, which is biased into seating engagement against a valve seat 24 within this passage by a compression spring 25 so that, during a suction stroke of plunger 2, fuel can be drawn into the pump cylinder through the open end of the bushing.

Figure 6:
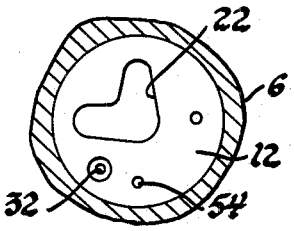
FIG. 6 is a partial sectional view taken along line 6—6 of FIG. 2.
Figure 8:
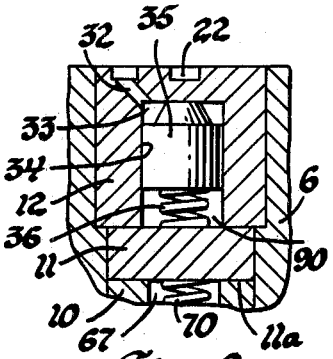
FIG. 8 is a partial sectional view showing the accumulator cage of the injector rotated with respect to its position shown in FIG. 4 to show the fuel delivery path therein to the accumulator cage.
Figure 7:
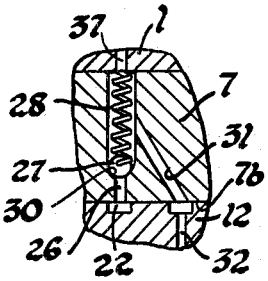
FIG. 7 is a partial sectional view showing the bushing of the injector rotated with respect to its position in FIG. 4 to further show the discharge flow path of fuel.

During a pump stroke of plunger 2, fuel is discharged from the open end of the bushing at an intensified pressure into the recessed cavity 22 which is of a configuration, as shown in FIG. 6, so as to also be in communication with one end of an intensified fuel or discharge passage means that includes a passage 26, provided in the bushing 7, with flow therethrough controlled by a one-way check valve that includes a ball 27 and a spring 28 which normally biases the ball 27 into seating engagement with its cooperating valve seat 30. The discharge passage means further includes as shown in FIG. 7, a downwardly directed passage 31 in bushing 7 which at one end intersects the passage 26 downstream of ball 27 and which at its other end opens into the enlarged end of a stepped passage 32 provided in the accumulator cage 12, this latter passage 32 supplying fuel to an accumulator chamber 33 in the accumulator cage 12.

With this arrangement, during a pump stroke of plunger 2, part of the fuel at an intensified pressure discharged therefrom is delivered via the above described portion of the discharge passage means to the accumulator chamber 33 in the accumulator cage 12. As shown, this accumulator cage 12 is of inverted cup shape with a bored opening extending from one end thereof, the lower end with reference to the drawings, to provide a cylindrical inner wall 34 which slidably receives an inverted, cup-shaped accumulator piston 35, the piston 35 forming with the annular wall 34 the accumulator chamber 33 adjacent to the closed, upper end of the accumulator cage 12. A rate spring 36, of predetermined value, positioned within the recessed opening of the accumulator cage 12 normally biases the accumulator piston 35 in an axial direction, upward with reference to the drawings, whereby to reduce the volume of fluid in the accumulator chamber 33.

Figure 2:
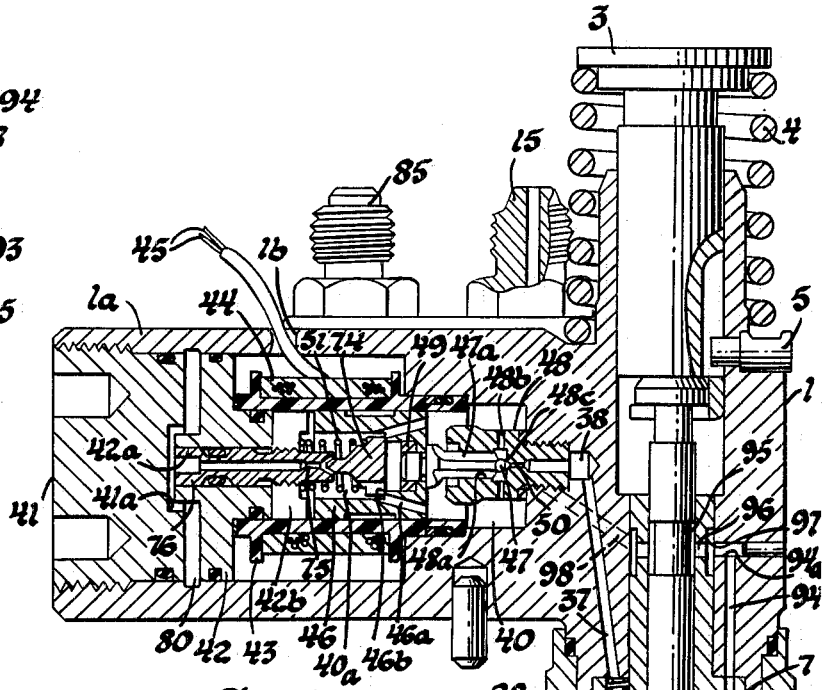
FIG. 2 is a longitudinal, sectional view of an electromagnetic unit fuel injector in accordance with the invention, this view being taken along line 2—2 of FIG. 3 with the elements of the injector being shown with the plunger of the pump thereof positioned prior to the start of a pump stroke and the electromagnetic means thereof de-energized.

As best seen in FIG. 2, the discharge passage means carrying fuel at an intensified pressure also includes a passage 37 in housing 1 which connects at one end to the enlarged upper end of passage 26 and at its other end connects to a flow chamber or passage 38 for controlled communication with a pressure control chamber 40 in a manner now to be described.

The upper end of housing 1 includes a side housing extension **1*a* having a stepped counterbore extending from the free end of extension 1*a* to provide an internal chamber closed at one end by a cap nut 41 threaded into the free end of the side housing extension. An electromagnetic unit in the form of a solenoid assembly is mounted within this chamber at the end of the housing extension 1*a*, the solenoid assembly including a pole or core 42, suitably fixed in the housing extension 1*a*, and having a tubular bobbin 43 fixed thereto with a solenoid coil 44 wrapped around the bobbin 43. The electrical leads 45 to the coil 44 extend outward through an aperture 1*b* in the side wall of the side housing extension 1*a* for connection to a suitable electrical control circuit, not shown, whereby the coil 44** can be energized or de-energized as a function of engine operation in a manner well known in the art.

The solenoid assembly also includes a movable cup-shaped armature 46 slidable in bobbin 43 to which one end of a needle-type control valve 47 is secured for movement therewith. The control valve 47, which has a splined intermediate portion **47*a*, is reciprocably received in the axial, stepped bore 48*a* of a valve cage 48, the reduced diameter end of this cage being threaded into a suitable portion of the counterbore forming, in part, the passage 38 within the housing 1. A reduced diameter portion of the bore 48*a* in the valve cage 48 provides a metering orifice passage 50, flow through which is controlled by the conical valve tip of the control valve 47 that is adapted to seat against a valve seat 48*c* in the valve cage 48. A compression rate spring 51, with a predetermined spring rate and force, positioned within the open-end chamber in the armature 46, is used to normally bias the control valve 47 into a closed position against valve seat 48c to block flow through the metering orifice passage 50 into control chamber 40. As shown, the spring 51 is in abutment at one end against the radial slotted lower end 42b of the core 42 whereby to bias the control valve 47 in a direction, to the right with reference to FIG. 2, to cause it to seat relative to the metering orifice passage 50 against the force of fuel pressure in the discharge passage means flowing into passage 38**.

Figure 5:
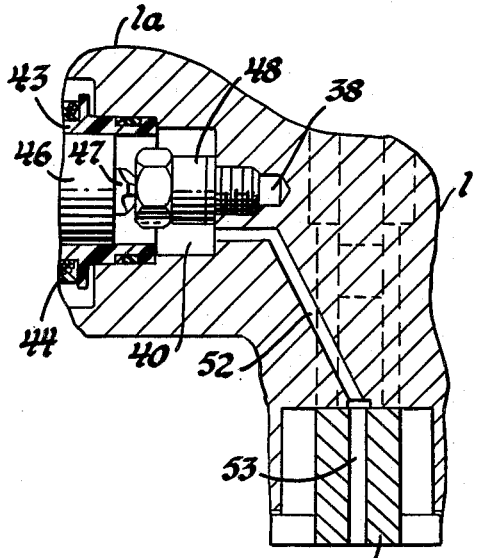
FIG. 5 is a sectional view taken along line 5—5 of FIG. 3.

Referring now to FIGS. 4 and 5, the pressure control chamber 40 is also connected so as to be in direct fluid communication with the interior of the valve body 8 of the injector nozzle by a control pressure passage means which includes a passage 52 in housing 1, connected between the pressure control chamber 40 and one end of a passage 53 through bushing 7, passage 54 through accumulator cage 12, passage 55 through cross-over cage 11, a passage 56 through the rate spring cage 10 which opens into an annular groove or channel 57 at the lower end with reference to FIGS. 4 and 2, of the rate spring cage 10 and one or more drilled passages 58 in the valve body 8 which open into the annular fuel chamber or passage 60 in valve body 8 surrounding the needle-type, injection valve 61, the passage 60 being in communication with the spray orifices 62 at the lower end of the valve body, as controlled by the injection valve 61. As illustrated, the injection valve 61, of known construction, is movably positioned in the valve body 8 for controlling the discharge of fuel out through the spray orifices 62 in a known manner.

As shown, discharge of fuel through the spray orifices 62 is controlled by the injection valve 61 whose lower conical end normally closes off fuel flow through these spray orifices 62 by engaging the frusto-conical valve seat 63 within the valve body 8 adjacent to its lower end upstream of spray orifices 62. The injection valve 61 is slidably guided by its enlarged upper end in the bore 64 at the upper end of the valve body 8, the bore 64 terminating at its upper end in an annular recess 65 formed in the upper end surface of the valve body 8. The bore 64 and annular recess 65 are coaxially aligned, in the construction shown, with a bore 66 in the lower end of the rate spring cage 10, the bore 66 extending to a spring chamber 67 in the rate spring cage as provided by the open end, cup-shaped configuration of this cage. The upper end of the spring chamber 67 is closed by the lower surface 11a of the cross-over cage 11.

In the construction shown, the injection valve 61 is provided at its upper end with a pin portion 61a extending from the enlarged stem portion thereof to be loosely received in the bore 66 so as to extend into the spring chamber 67 whereby it can abut against a valve spring seat 68. The injection valve 61 is thus normally movable to an unseated position relative to seat 63 against the biasing action of a coiled valve spring 70, of predetermined force, located in the spring chamber 67, this spring 70 being seated at its upper end against the cross-over cage 11 and at its lower end on the valve spring seat 68, with movement of the injector valve in the opening direction being limited by engagement of the shoulder 61b thereof against the bottom surface of the rate spring cage 10.

The injector nozzle assembly and rate cage assembly, thus far described, is such that unseating of the injection valve 61 will occur with fuel in the annular passage 60 at an injection pressure $P_o$ and the needle valve will close at a closing pressure $P_c$. The injection pressure $P_o$ is congruent to the closing pressure $P_c$ plus the force of the spring 70.

Again referring to the pressure control chamber 40, it is of annular configuration defined by the head of the valve cage 48 and an interior end of the bobbin 43 of the solenoid assembly and, it is supplied with pressurized fuel via the metering orifice passage 50, as controlled by the valve 47, with fuel from the metering orifice passage 50 flowing through the flow passage provided by the split intermediate portion 47a of the control valve 47 in the enlarged portion of stepped bore 48a and, through the radial passages 48b in the valve cage 48 downstream of valve seat 48c. A chamber 40a, as provided by the central bore extending from one end of the armature 46, is in communication with the control chamber 40 via the passages 46a extending through the base of the armature 46 and may be considered to be an extension of the control chamber 40.

A bleed or retractor valve 74 is loosely positioned in the chamber 40a of armature 46 to control fluid flow from the chambers 40 and 40a to a fuel drain passage means for fuel at low pressure through an injector bleed or retractor orifice 75 at the inlet end of an injector retractor valve orifice tube 76 that is adjustably, threadably secured in the central through bore 42a of the core 42, as seen in FIG. 2. As shown, the retractor orifice 75 is axially aligned relative to the metering orifice passage 50. The retractor valve 74 is movable with the armature 46 since it is engaged by the opposite end of the previously described compression rate spring 51 whereby it is forced into abutment against a shoulder 46b of the armature 46. Thus, both the retractor valve 74 and the control valve 47 are movable with the armature 46, the control valve 47 having its reduced diameter upper stem portion extending through a suitable aperture provided for this purpose in one end of the armature to receive a retainer 49 secured to this stem portion as by a press fit whereby the control valve 47 is operatively connected to the armature.

Figure 3:
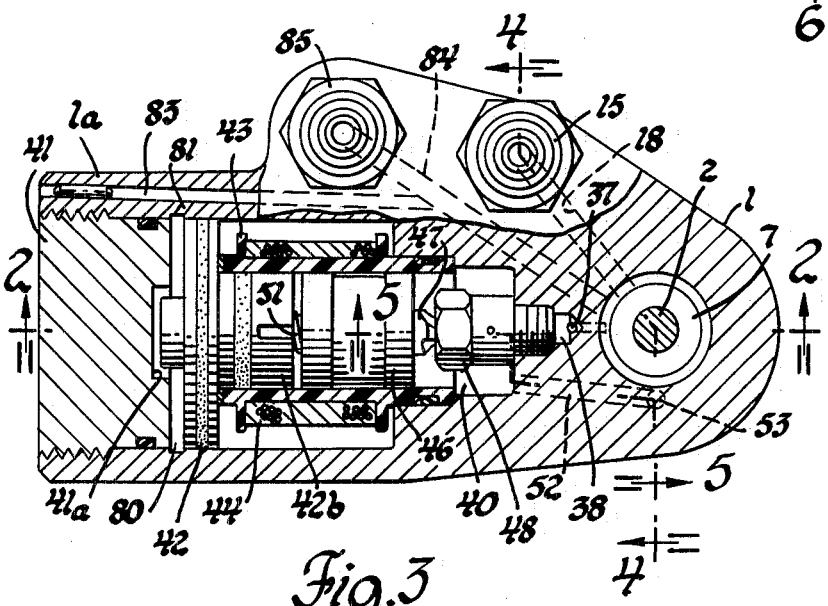
FIG. 3 is a top view of the subject electromagnetic unit fuel injector with portions broken away to show the structural relationship of various elements of the injector.

Central bore 42a of the core 42 and, therefore, the orifice tube 76 are in communication with an annular fuel return chamber 80 surrounding the reduced diameter end portion of the core 42 next adjacent to the cap nut 41 and which projects partly into the annular cavity 41a at the inner end of the cap nut 41. This fuel return chamber 80, as seen in FIG. 3, forms part of the fuel drain passage means for the return of fuel to the fuel tank used to supply fuel to this unit injector and includes a radial passage 81 opening into chamber 80 in the side housing extension 1a that connects via a drain passage 83 and an intersecting return conduit passage 84 in housing 1 to the apertured fuel outlet or drain fitting 85 threaded into the housing. Drain fitting 85 is adapted to be connected by a suitable fuel return conduit, not shown, to the fuel tank, not shown, containing fuel at approximately atmospheric pressure.

The accumulator piston 35, as slidably received within the accumulator cage 12, also acts as a pressure relief valve since, upon downward movement of the accumulator piston from its position shown, for example, in FIG. 2, it will uncover a side relief port 86 that is located a predetermined axial distance from the upper end of the accumulator chamber 33. This relief port 86 connects to the fuel drain passage means which further includes a drain passage 87 extending axially through the accumulator cage 12. At one end, its lower end as seen in FIG. 2, the drain passage 87 is also connected by a side port 88 to the chamber 90 at the lower end of the accumulator cage, that is, the end opposite the accumulator chamber 33. This end of the drain passage 87 also connects via a drain passage 91 in cross-over cage 11 with a drain passage 92 in the rate spring cage 10 that is in communication with the spring chamber 67 containing the compression rate spring 70, whereby the spring cage contains fuel at substantially low pressure. At its opposite end, the drain passage 87 is in flow communication with a drain passage 93 extending through the bushing 7 to interconnect with a drain passage 94 in the housing 1.

Bypass leakage from the plunger 2 accumulates in an undercut annulus 95 formed intermediate the ends of the plunger 2 and flows through radial passages 96 in bushing 7 to a recessed annulus 97 on the outer peripheral surface of the bushing, this annulus 97 being connected through a side passage 94*a* to the passage 94 in housing 1 and it is ported through a passage 98 in housing 1 to the return conduit passage 84 previously described.

FUNCTIONAL DESCRIPTION

Referring now to the drawings and, in particular, to FIG. 1, low pressure fuel is supplied to the supply fitting 15 and through the inlet passage means including filter 17 into the pressure intensification pump chamber via the open end of the bushing 7 wherein the fuel pressure is intensified to a substantially high pressure, for example, 15,000 psi, during the downward stroke of the follower 3 moving the plunger 2 on its pump stroke within the bushing 7. The high fuel pressure as thus developed flows through the discharge passage means including metering orifice passage 50 as controlled by the ball check valve 27 toward the pressure control chamber 40, with actual flow to the chamber 40 being blocked by control valve 47 which remains closed when the solenoid coil 44 is not energized. Fuel at an intensified pressure also flows through the passages 31 and 32 into the pressure accumulator chamber 33 whereby the quantitative intensified supply pressure can be stored by the displacement of the accumulator piston 35 against the biasing action of the spring 36. Fuel in the chamber 90, at the opposite end of the accumulator piston 35, being discharged upon downward movement of the accumulator piston through the fuel drain passage means, previously described, of the subject unit injector.

An electrical (current) pulse of finite characteristic and duration timed relative to the top-dead-center of engine piston position, not shown, with respect to the camshaft and injector arm linkage, all not shown, applied through the leads 45 to the coil 44 produces an electromagnetic field attracting armature 46 to the core 42 whereby to raise the solenoid control valve 47 from its valve seat 48*c* and to effect closing of the retractor valve 74 blocking flow from the control chamber 40 out through the retractor orifice 75. The high pressure fuel in the discharge passage means can then flow into the control chamber 40 via the metering orifice passage 50 and then from the control chamber to the injection nozzle, specifically to the annular passage 60 in the valve body 8. When the fuel pressure in this passage 60 raises to the predetermined opening pressure $P_o$ of the injection valve 61, it will cause this valve to lift off the valve seat 63 so that fuel is then discharged out through the spray orifices 62 into the combustion chamber, not shown, with which this unit injector is associated.

After a predetermined time interval, termination of the electrical pulse then collapses the electromagnetic force between the core 42 and the armature 46. When this occurs, the force of the rate spring 51 will provide a fast response closure of the control valve 47 and opening of the retractor valve 74 so that the pressure in the control chamber and in the control pressure passage means to the injection nozzle will be rapidly dissipated at a predetermined rate. When the pressure of fuel in the control chamber 40 and in the control pressure passage means drops to the injection valve 61 closing pressure $P_c$, injection is terminated. The closing pressure $P_c = F_1/A$ wherein: $F_1$ is the force of rate spring 70; and, "A" is the effective area of the injection valve 61, as shown in FIG. 1.

In the subject unit injector, using the injection nozzle shown, the injection valve 61 opening pressure $P_o$ will be higher than its closing pressure $P_c$ and these pressures are consistent with the opening and closing pressures normally found in a conventional unit injector. The decay rate of the injection pressure is readily controlled, as desired, by proper sizing of the retractor orifice 75. In view of this fact, it will now be apparent to those skilled in the art that, in a similar manner, the initial pressure rate slope of injection may be controlled by adding a suitable flow control orifice, not shown, in the passage 55, for example, of the control pressure passage means.

Fuel leakage from the injection nozzle assembly, specifically fuel leakage from around the injection valve 61 as journaled in the bore 64 of the valve body, will flow into the spring chamber 67 in the rate spring cage 10 from where it is discharged through the previously described fuel drain passage means back to the fuel tank, not shown. As previously described, fuel discharged from the relief port 86 in the accumulator cage 12, as well as from the side port 88 thereof, unite with the bypass leakage from around the plunger 2 to flow back to the fuel tank, not shown, through the fuel drain passage means previously described.

The response control of the subject electromagnetic unit fuel injector is such so as to permit pilot injection with minimum durations of 0.2 millisecond electronically timed with respect to the camshaft position (T.D.C.) on a system RPM/load schedule.

It will be apparent to those skilled in the art that numerous changes and modifications can be made to the preferred embodiment of the subject electromagnetic unit fuel injector illustrated and described, without departing from the teachings of this invention. For example, the metering orifice passage 50, instead of being provided in the valve cage 48, as illustrated, could readily be positioned anywhere in the fuel discharge passage means between the passage 26 and the solenoid actuated control valve 47. Furthermore, although in the construction illustrated, the plunger 2 and bushing 7 are not provided with helices and radial ports, respectively, as is conventional in unit injectors, it will be apparent to those skilled in the art that the plunger and bushing could be modified so as to provide the plunger with helices thereon to control the flow of fuel through radial ports provided in the bushing in a manner well known in the art, it being realized that it is only necessary that these elements be designed so as to permit a thus modified pump assembly to deliver a suitable predetermined amount of fuel during all modes of engine operation so that injection of fuel is controlled by operation of the electromagnetic control valve in the manner previously described and so that sufficient excess fuel is delivered by the pump for the purpose of cooling the various elements of the subject unit injector.

What is claimed is:

1. An electromagnetic unit fuel injector including a housing means having a fuel inlet and a fuel drain outlet adjacent one end thereof, said housing means including a valve body terminating in a spray outlet at its other end, a pump cylinder in said housing means, a plunger reciprocable in said cylinder, said cylinder being open at one end for the ingress and egress of fuel during reciprocation of said plunger, a valve controlled inlet passage means in said housing means connecting said inlet to said open end of said cylinder, discharge passage means including a one-way valve connected at one end to said open end of said cylinder, a control pressure passage means in said housing means terminating at one end at said spray outlet, an injection valve slidably positioned in said valve body in position to close said spray outlet, a pressure control chamber in said housing means, said pressure control chamber having a control orifice inlet port connected to said discharge passage means downstream of said one-way valve, an outlet in communication with said control pressure passage means and, a bleed return passage means, including a bleed orifice positioned opposite and in line with said control orifice inlet port, in communication with said fuel drain outlet, a pressure accumulator chamber in said housing means, a piston reciprocable in said pressure accumulator chamber, passage means connecting said discharge passage means, downstream of said one-way valve, to one end of said pressure accumulator chamber, drain passage means connecting the opposite end of said pressure accumulator chamber to said fuel drain outlet, a spring positioned in said pressure accumulator chamber to normally bias said piston toward the end of said pressure accumulator chamber in communication with said discharge passage means, a spring cage chamber in said housing means in fluid communication with said opposite end of said pressure accumulator chamber, spring means in said spring cage chamber operatively abutting against said injection valve to normally bias said injection valve into closing engagement relative to said spray outlet and, a solenoid actuated valve means positioned in said housing and including a valve means positioned in said control chamber for movement between a first position to control the flow of fluid from said discharge passage means through said control orifice inlet port into said pressure control chamber for flow to said control pressure passage means while blocking flow of fluid from said pressure control chamber through said bleed return passage means and a second position blocking flow of fluid through said control orifice inlet port while permitting flow of fluid from said control chamber out through said bleed return passage means.

2. An electromagnetic unit fuel injector according to claim 1 wherein said drain passage means includes a relief port opening into said pressure accumulator chamber intermediate the ends thereof to be uncovered by said piston upon predetermined axial movement thereof within said pressure accumulator chamber against the biasing action of said spring.

3. An electromagnetic unit fuel injector including a housing means having a fuel inlet and a fuel drain outlet at one end thereof and including a valve body, terminating in a spray outlet at its other end, a pump cylinder in said housing means, a plunger reciprocable in said cylinder, said cylinder having an open end for the ingress and egress of fuel during reciprocation of said plunger, a valve controlled inlet passage means in said housing means connecting said inlet to said cylinder open end, discharge passage means having a check valve therein connected at one end to said cylinder open end with said check valve next adjacent thereto, a pressure control chamber in said housing means, said discharge passage means including a conduit means with a metering orifice passage opening into one end of said pressure control chamber, a control pressure passage means in said housing means connected at one end to said pressure control chamber and terminating at its other end at said spray outlet in said valve body, an injection valve movable in said valve body with one end thereof movable between a closed position and an open position relative to said spray outlet, a pressure accumulator means in said housing means having one end thereof in communication with said discharge passage means, drain passage means in said housing means connected at one end to said drain outlet and including drain conduit means connected to the opposite end of said pressure accumulator means and a bleed orifice passage means opening into the opposite end of said pressure control chamber from said metering orifice passage, a spring chamber in said housing means, said injection valve having its other end thereof projecting into said spring chamber, a rate spring means in said spring chamber normally biasing said injection valve to said closed position, said drain passage means being in communication with said spring chamber, and solenoid actuated valve means operatively positioned to selectively permit flow of fuel through said metering orifice passage into said pressure control chamber while blocking flow from said pressure control chamber out through said bleed orifice passage means and then to block flow through said metering orifice passage into said pressure control chamber while permitting flow therefrom out through said bleed orifice passage means.

4. An electromagnetic unit fuel injector including a housing means having a fuel inlet and a fuel drain outlet, a pump cylinder in said housing means, a cam actuated plunger reciprocable in said cylinder, said cylinder being open at one end for discharge of fuel displaceable by said plunger during a pump stroke and for fuel intake during a suction stroke of said plunger, a valve controlled fuel inlet passage means connecting said fuel inlet to said cylinder open end, a fuel injector including a valve body carried by said housing means, said valve body having a spray outlet at one end thereof for the discharge of fuel, an injection valve movable in said valve body between an open position and a closed position relative to said spray outlet, a pressure chamber in said housing means, a discharge passage means having a check valve therein next adjacent said cylinder open end connecting said cylinder open end to one end of said pressure chamber, said discharge passage means further including a metering orifice passage next adjacent said pressure chamber, a control pressure passage means connecting said pressure chamber to said spray outlet, a spring chamber in said housing means, a bore in said valve body slidably guiding said injection valve and opening into said spring chamber, said injection valve having a piston portion exposed to fuel pressure in said control pressure passage means adjacent said spray outlet for effecting movement of said injection valve to said open position, a spring positioned in said spring chamber to bias said injection valve to said closed position, a drain passage means connected at one end to said fuel drain outlet and including at an opposite end a bleed orifice passage opening into said pressure chamber in axially aligned spaced apart relation to said metering orifice passage, solenoid actuated valve means including an armature movable in said control chamber and supporting a control valve and an opposed bleed valve for movement therewith and a spring means operatively connected thereto for normally biasing said control valve to a position blocking flow through said metering orifice passage into said control chamber and said bleed valve to a position to permit flow from said control chamber out through said bleed orifice passage, and pressure accumulator means in said housing means in communication with said discharge passage means that is operative to store fuel up to a predetermined pressure during a pump stroke of said plunger.

5. An electromagnetic unit fuel injector including a housing means having a fuel inlet and a fuel drain oulet at one end thereof, a fuel injector including a valve body carried by said housing means at its opposite end, said valve body having a spray outlet at one end exterior of said housing means, an injection valve movable in said valve body to open and close said spray outlet, a pump cylinder in said housing means, a cam actuated plunger reciprocable in said cylinder, said cylinder having an open end for the ingress and egress of fuel during a suction stroke and a pumping stroke, respectively, of said plunger, a valve controlled inlet passage means in said housing means connecting said inlet to said cylinder open end, discharge passage means including a check valve connected at one end to said cylinder open end, said check valve being positioned next adjacent to said cylinder open end, a pressure accumulator chamber in said housing means connected at one end to said discharge passage means downstream of said check valve, an accumulator piston slidably journaled in said pressure chamber, a spring means positioned in said chamber to abut against said accumulator piston whereby fuel discharged during a pump stroke of said plunger can be stored under pressure within said pressure accumulator chamber, a pressure control chamber in said housing means, said discharge passage means including a metering orifice passage means opening into one end of said control chamber, a drain passage means connected to said fuel drain outlet, said drain passage means including bleed orifice passage means opening into said control chamber on the end thereof opposite said metering orifice passage means and axially aligned therewith, a control pressure passage means in fluid communication at one end with said control chamber and terminating at said spray outlet, solenoid actuated valve means operatively positioned to selectively connect said control pressure passage means via said control chamber in fluid communication with said metering orifice passage means and then with said bleed orifice passage means, a spring chamber in said housing means, rate spring means positioned in said spring chamber and operatively connected to said injection valve for normally positioning said injection valve to block flow through said spray outlet, and said spring chamber being in flow communication with said drain passage means.

* * * * *